US009673513B2

(12) United States Patent
Hong et al.

(10) Patent No.: US 9,673,513 B2
(45) Date of Patent: Jun. 6, 2017

(54) RADIATOR FRAME HAVING ANTENNA PATTERN EMBEDDED THEREIN AND ELECTRONIC DEVICE INCLUDING THE SAME

(71) Applicant: Samsung Electro-Mechanics Co., Ltd., Suwon-si (KR)

(72) Inventors: Ha Ryong Hong, Suwon-si (KR); Sun Hee Lee, Suwon-si (KR); Chan Gwang An, Suwon-si (KR); Dae Ki Lim, Suwon-si (KR); Hyeon Gil Nam, Suwon-si (KR); Sung Eun Cho, Suwon-si (KR); Dae Kyu Lee, Suwon-si (KR); Dae Seong Jeon, Suwon-si (KR); Hyun Do Park, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 78 days.

(21) Appl. No.: 14/834,063

(22) Filed: Aug. 24, 2015

(65) Prior Publication Data

US 2016/0056532 A1 Feb. 25, 2016

(30) Foreign Application Priority Data

Aug. 25, 2014 (KR) ..... 10-2014-0110977
Dec. 11, 2014 (KR) ..... 10-2014-0178231

(51) Int. Cl.
*H01Q 9/42* (2006.01)
*H01Q 1/24* (2006.01)
*H01Q 5/371* (2015.01)

(52) U.S. Cl.
CPC ..... *H01Q 1/243* (2013.01); *H01Q 5/371* (2015.01); *H01Q 9/42* (2013.01)

(58) Field of Classification Search
CPC ..... H01Q 1/36; H01Q 1/243
See application file for complete search history.

(56) References Cited

U.S. PATENT DOCUMENTS

2010/0012530 A1 1/2010 Watanabe et al.
2010/0271283 A1 10/2010 Sung et al.
(Continued)

FOREIGN PATENT DOCUMENTS

JP 2012-227850 A 11/2012
KR 10-2009-0035636 A 4/2009
(Continued)

OTHER PUBLICATIONS

Korean Office Action issued on Jan. 5, 2016, in counterpart Korean Application No. 10-2014-0178231 (7 pages in English, 5 pages in Korean).

*Primary Examiner* — Dameon E Levi
*Assistant Examiner* — Andrea Lindgren Baltzell
(74) *Attorney, Agent, or Firm* — NSIP Law

(57) ABSTRACT

A radiator frame includes: a main radiator including an antenna pattern part configured to transmit or receive a signal, an internal terminal part provided on one end of the antenna pattern part and configured to electrically connect the antenna pattern part and a circuit substrate, and an external terminal part provided on another end of the antenna pattern part and configured to be connected to an auxiliary radiator to improve radiation performance of the antenna pattern part; and a molded frame molded around the radiator, the molded frame allowing the internal terminal part to be exposed at a first surface of the molded frame, and allowing the external terminal part to be exposed at a second surface of the molded frame.

13 Claims, 11 Drawing Sheets

(56) References Cited

U.S. PATENT DOCUMENTS

| | | | | |
|---|---|---|---|---|
| 2012/0001807 | A1 | 1/2012 | Lee et al. | |
| 2012/0299785 | A1 | 11/2012 | Bevelacqua | |
| 2013/0088406 | A1* | 4/2013 | Hamada | H01Q 1/36<br>343/893 |
| 2014/0225787 | A1* | 8/2014 | Ramachandran | H01Q 1/24<br>343/702 |

FOREIGN PATENT DOCUMENTS

| | | | |
|---|---|---|---|
| KR | 10-2010-0117010 | A | 11/2010 |
| KR | 10-2011-0125714 | A | 11/2011 |
| KR | 10-2012-0002278 | A | 1/2012 |
| KR | 10-2012-0133368 | A | 12/2012 |

* cited by examiner

RADIATOR FRAME HAVING ANTENNA PATTERN EMBEDDED THEREIN AND ELECTRONIC DEVICE INCLUDING THE SAME

CROSS-REFERENCE TO RELATED APPLICATION(S)

This application claims the benefit of Korean Patent Application No. 10-2014-0110977 filed on Aug. 25, 2014, in the Korean Intellectual Property Office, and Korean Patent Application No. 10-2014-0178231 filed on Dec. 11, 2014, in the Korean Intellectual Property Office, the entire disclosures of which are incorporated herein by reference for all purposes.

BACKGROUND

1. Field

The following description relates to a radiator frame having an antenna pattern embedded therein and an electronic device including the same.

2. Description of Related Art

In recent years, radiator frames that are manufactured by injection-molding processes have been developed. For example, such a radiator frame may be manufactured by injection-molding a resin material around a radiator or subjecting a previously formed frame member to injection-molding to embed the radiator in an antenna pattern frame or inside an electronic device case.

Furthermore, an electronic device case may include a metal component disposed on the exterior of the electronic device case and intended for use as an antenna. In such an electronic device case, a configuration in which the metal component is connected to a radiator provided inside the electronic device is required.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

According to one general aspect, a radiator frame may include: a main radiator including an antenna pattern part configured to transmit or receive a signal, an internal terminal part provided on one end of the antenna pattern part and configured to electrically connect the antenna pattern part and a circuit substrate, and an external terminal part provided on another end of the antenna pattern part to be connected to an auxiliary radiator to improve radiation performance of the antenna pattern part; and a molded frame disposed around the main radiator, the molded frame allowing the internal terminal part to be exposed at a first surface of the molded frame, and allowing the external terminal part to be exposed at a second surface of the molded frame.

The antenna pattern part may be exposed at the second surface of the molded frame.

The main radiator may include an external connection part that is bent on the antenna pattern part and connects the antenna pattern part to the external terminal part.

The antenna pattern part may include a support part that is connected to the external connection part and embedded in the molded frame.

A portion of the support part connected to the external connection part may be exposed to the first surface of the molded frame.

The support part may be bent on the other end of the antenna pattern part to be embedded in the first surface of the molded frame.

The external terminal part may be spaced apart from the second surface of the molded frame, and may be configured to be elastically supported.

An elastic member may be disposed between the molded frame and the external terminal part.

The external terminal part may be bent to be spaced apart from the second surface of the molded frame after injection-molding the molded frame around the main radiator.

According to another general aspect, an electronic device may include a case and a radiator frame mounted in the case. The radiator frame may include: a radiator including an antenna pattern part configured to transmit or receive a signal, an internal terminal part provided on one end of the antenna pattern part, and an external terminal part provided on another end of the antenna pattern part; and a molded frame disposed around the radiator, the molded frame allowing the internal terminal part to be exposed at a first surface of the molded frame, and allowing the external terminal part to be exposed at a second surface of the molded frame. The electronic device may further include: a circuit substrate electrically connected to the internal terminal part and configured to receive the signal from the radiator or transmit the signal to the radiator; and a metal frame disposed on the case and electrically connected to the external terminal part.

The metal frame may have a ring shape.

The external terminal part may be elastically supported on the metal frame.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed as will be apparent to one of ordinary skill in the art, with the exception of operations necessarily occurring in a certain order. Also, descriptions of functions and constructions that are well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will convey the full scope of the disclosure to one of ordinary skill in the art.

Figure 1:
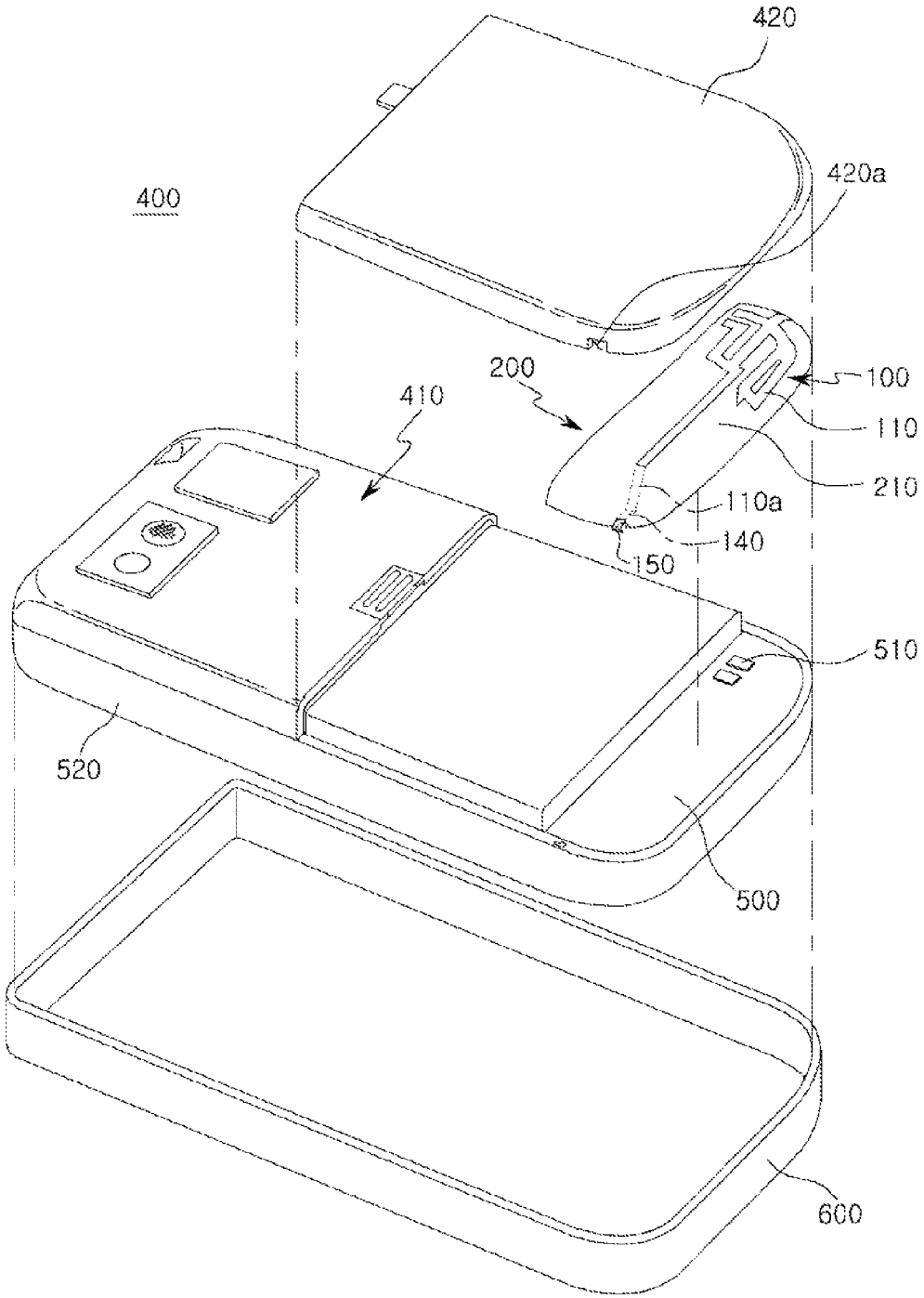
FIG. 1 is a schematic perspective view illustrating an example of a manner in which a radiator frame is coupled to a case of a mobile communications terminal.
Figure 2:
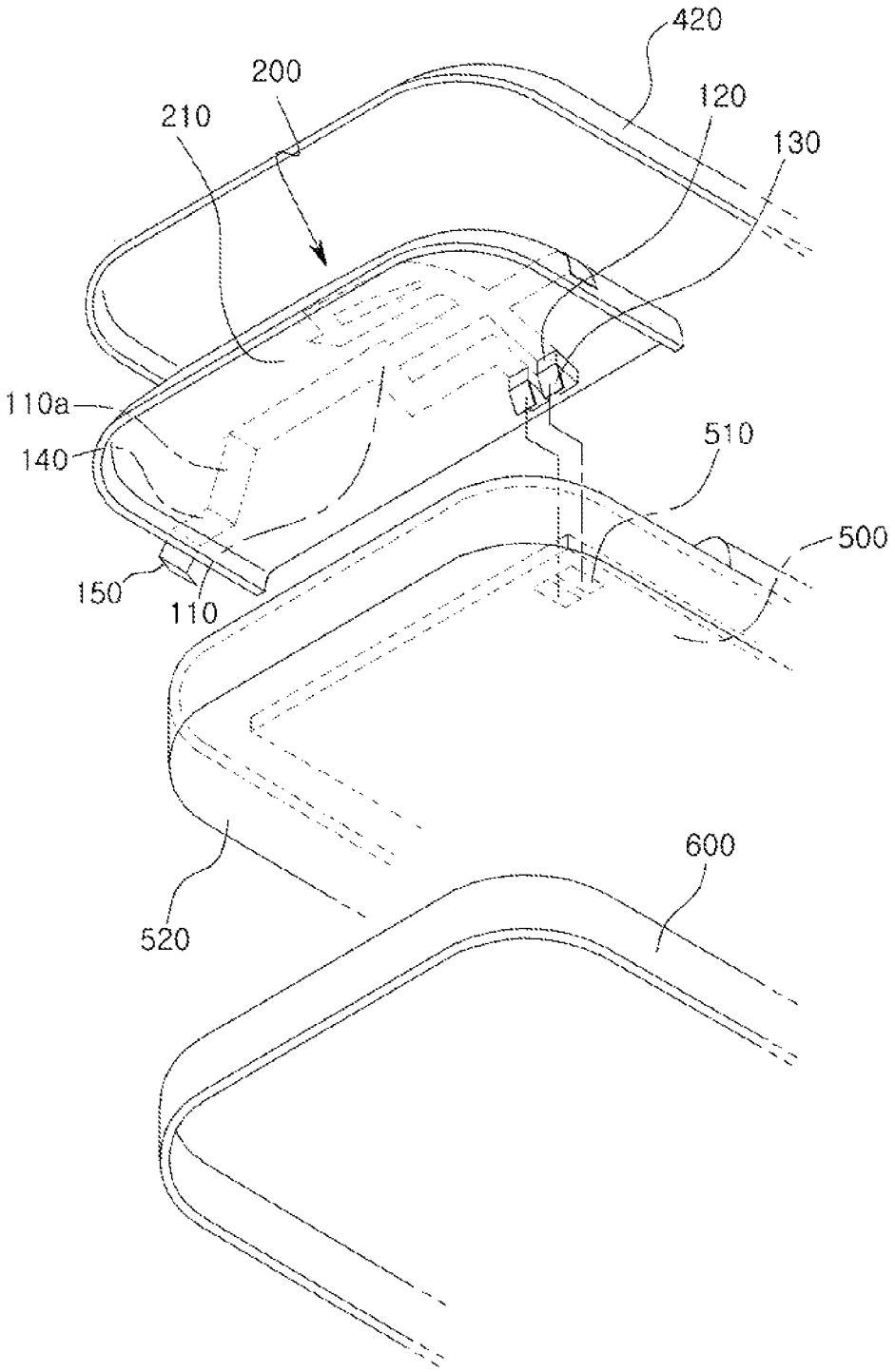
FIG. 2 is an exploded perspective view of an example of the mobile communications terminal manufactured using the radiator frame.

FIG. 1 is a schematic perspective view illustrating an example of a manner in which a radiator frame is coupled to a case of a mobile communications terminal, and FIG. 2 is an exploded perspective view of an example of the mobile communications terminal manufactured using the radiator frame.

Referring to FIGS. 1 and 2, a mobile communications terminal 400 includes a case 410 and 520, a battery cover 420 covering a battery mounting part (not shown), a radiator frame 200 disposed in the case 410 and 520, and a metal frame 600 disposed in a ring shape along an edge of the case 410 and 520. It should be understood that, although the description and drawings disclose the radiator frame 200 being provided in the mobile communications device 400, the radiator frame 200 may be provided in other types of electronic devices.

The radiator frame 200 may be formed by embedding a main radiator 100 (hereinafter, "radiator") including an antenna pattern part 110 in a molded frame 210 through an injection-molding scheme.

In addition, the radiator 100 includes an internal terminal part 130 exposed through a first surface of the molded frame 210 and configured to be connected to a circuit substrate 500 provided in the mobile communications terminal 400. Further, the radiator 100 includes an external terminal part 150 exposed through a second surface of the molded frame 210, opposing the first surface of the molded frame 210, and configured to be connected to the metal frame 600.

The internal terminal part 130 is connected to a terminal 510 of the circuit substrate 500 to enable the radiator frame 200, when mounted in the mobile communications terminal 400, to improve antenna performance of the mobile communications terminal 400.

Further, the external terminal part 150 is connected to the metal frame 600, and the metal frame 600 may act as an antenna, thereby further improving antenna performance of the mobile communications terminal 400.

The internal terminal part 130 and the external terminal part 150 may elastically contact the terminal 510 and the metal frame 600 to provide a reliable connection between the terminal 510 and the metal frame 600, respectively. Therefore, during the molding of the radiator 100 in the molded frame 210, the internal terminal part 130 and the external terminal part 150 are positioned to be exposed externally of the molded frame 210 while having elastic force.

The external terminal part 150 may be fixed to the case 410 and 520 by using a predetermined fixation scheme (e.g., screw coupling, or the like) while being exposed externally, and thereafter, separately connected to the metal frame 600 using other connection lines, and the like.

In addition, the radiator frame 200 may be covered by the battery cover 420 while being mounted on the mobile communications terminal 400.

In a case in which the external terminal part 150 is covered by the battery cover 420, a connection with the metal frame 600 is not formed. Therefore, a contact groove 420*a* may be provided in a portion of the battery cover 420 at which the metal frame 600 is provided. In addition, the external terminal part 150 is exposed through the contact groove 420*a* to be connected to the metal frame 600. The contact groove 420*a* is covered by the metal frame 600 and may not be exposed externally.

According to an alternate embodiment, unlike the configuration depicted in FIGS. 1 and 2, the battery cover 420 may not cover the external terminal part 150. In such an embodiment, the contact groove 420*a* may not be provided.

When the antenna pattern part 110 is mounted in an electronic device such as the mobile communications terminal 400, or the like, the antenna pattern part 110 may be exposed externally if the antenna pattern part 110 is not covered with the battery cover 420. Therefore, a protective coating film (not illustrated) may be formed on the antenna pattern part 110 and the molded frame 210 at one surface of the radiator frame 200 at which the antenna pattern part 110 is exposed.

That is, the radiator frame 200 is mounted on the electronic device such as the mobile communications terminal 400, and in this case, an external surface of the radiator frame 200 may be additionally covered with a coating film, or the like. In more detail, a surface of the radiator frame 200 at which the antenna pattern part 110 is exposed externally may be additionally covered with the coating film, or the like.

The radiator frame 200 is not exposed externally when the radiator frame 200 is covered by the battery cover 420. However, the radiator frame 200 may be exposed externally when the battery cover 420 is opened in order to replace a battery, or the like, and thus, the coating film may be formed in consideration of aesthetics.

The coating film may be formed by dispensing a liquid through a coating process, a painting process, or the like, or may be simply formed as a ready-made article such as a film, a coating, or the like.

Figure 3:
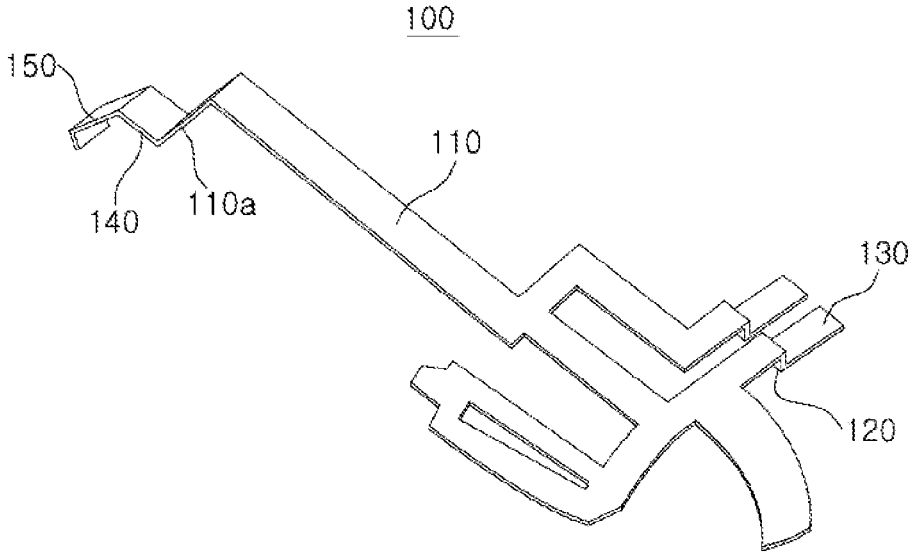
FIG. 3 is a schematic perspective view illustrating an example of a radiator provided in the radiator frame.

FIG. 3 is a schematic perspective view illustrating a radiator provided in the radiator frame according to an example embodiment.

Referring to FIG. 3, the radiator frame 200 may be manufactured by injection-molding the molded frame 210 around the radiator 100 to embed the radiator 100 in the molded frame 210. In addition, the antenna pattern part 110 is configured to transmit a signal to or receive a signal from a remote device or system, the internal terminal part 130 is configured to transmit a signal received by the antenna pattern part 110 to the circuit substrate 500 or receive a signal to be transmitted from the circuit substrate 500, and the external terminal part 150 is connected to the metal frame 600 provided on the edge of the case 410 and 520 in order to improve radiation performance of the antenna pattern part 110.

When the internal terminal part 130 is disposed to protrude toward a first surface of the antenna pattern part 110, the external terminal part 150 may be disposed to protrude toward a second surface of the antenna pattern part 110 opposing the first surface thereof.

In this manner, it may be easy to form connections between the substrate 500 and the internal terminal part 130, and between the metal frame 600 provided on the edge of the case 410 and 520 and the external terminal part 150.

Referring to FIG. 3, the radiator 100 may further include a support part 110*a* at an end of the antenna pattern part 110 and an external connection part 140 connected to the support part 110*a*. The external terminal part 150 may be connected to the external connection part 140.

The radiator 100 is made of a conductive metal such as aluminum or copper to receive an external signal and transfer the received external signal to a signal processing device the mobile communications terminal 400. Further, the antenna pattern part 110 may form a meander line in order to receive external signals in various bands.

The antenna pattern part 110 may receive an external signal and the connection terminal part 130 may contact the circuit substrate 500 of the mobile communications terminal 400 to transmit the external signal to the mobile communications terminal 400.

The external connection part 140 and the external terminal part 150 may extend from the antenna pattern part 110 to connect the radiator 100 to the metal frame 600.

In addition, during the forming of the radiator frame 200 by injection-molding the molded frame 210 around the radiator 100, the support part 110*a* may be exposed through a first surface of the radiator frame 200 so that the radiator 100 is easily seated on a predetermined position in a mold.

That is, the antenna pattern part 110 of the radiator 100 may be embedded in the molded frame 210 through injection-molding such that the terminal part 150 is exposed through the second surface of the radiator frame 200. Therefore, the antenna pattern part 110 is bent once or more toward the first surface of the radiator frame 200 from the second surface (furthermore, a portion of the antenna pattern part 110 may be exposed at the first surface of the radiator frame 200), and as a result, the portion of the antenna pattern part 110 may be strongly molded and fixed to the inside of the molded frame 210 and, thereafter, the external terminal part 150 may be exposed through the second surface of the radiator frame 200.

In other words, the radiator 100 may be formed in a 3D structure by bending the antenna pattern part 110, the internal terminal part 130 and the external terminal part 150 such that the antenna pattern part 110 and the connection terminal part 130 are connected by the internal connection part 120, and the support part 110*a* and the external terminal part 150 are connected by the external connection part 140.

The internal connection part 120 may connect the antenna pattern part 110 and the connection terminal part 130 such that the antenna pattern part 110 is formed at the second surface of the molded frame 210 and the internal terminal part 130 is formed at the first surface of the molded frame 210.

Further, the external connection part 140 may extend from the support part 110*a* in which the antenna pattern part 110 is bent toward the first surface of the molded frame 210 to be molded in the molded frame 210 so that the antenna pattern part 110 is formed on the second surface of the molded frame 210 and the external terminal part 150 is also formed on the second surface of the molded frame 210.

The internal connection part 120 may allow the antenna pattern part 110 and the internal terminal part 130 to be provided on different planes and allow the internal terminal part 130, which is not embedded in the molded frame 210, to be exposed at the second surface of the molded frame 210 opposing the first surface thereof at which the antenna pattern part 110 is formed.

In addition, the external connection part 140 may allow the antenna pattern part 110 and the internal terminal part 130 to be provided on the same plane and, to this end, as described above, the antenna pattern part 110 may be molded in the molded frame 210 or may include the support part 110*a* which is partially exposed at the first surface of the molded frame 210.

The internal terminal part 130 allows the signal received from the antenna pattern part 110 to be transmitted to the circuit substrate 500 and may elastically contact the terminal 510 of the circuit substrate 500 in order to provide reliable signal transfer. Moreover, since the external terminal part 150 is also connected to the metal frame 600 in order to improve radiation performance of the antenna pattern part 110, the external terminal part 150 may elastically contact the metal frame 600 in order to provide reliable signal transfer.

Figure 5:
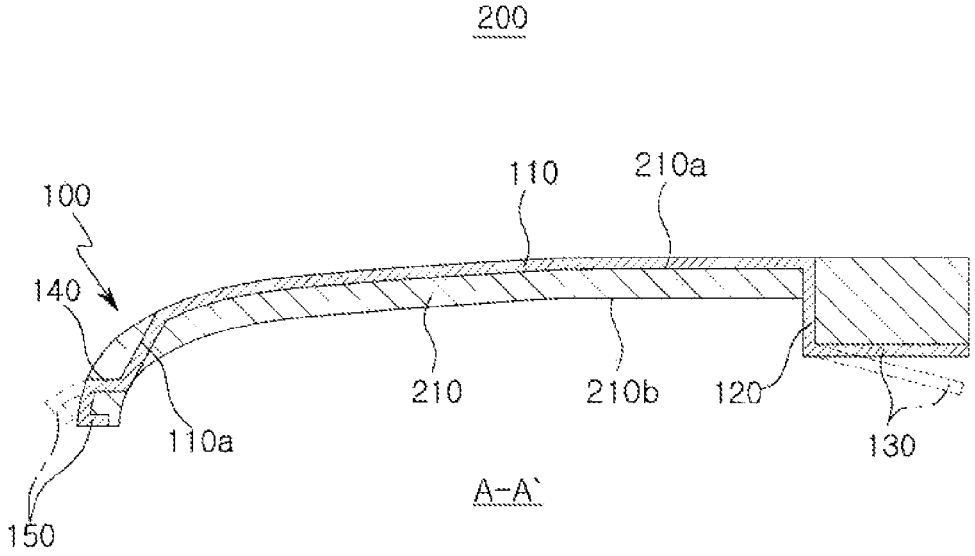
FIG. 5 is a schematic cross-sectional view taken along line A-A' of FIG. 4.

Therefore, the internal terminal part 130 and the external terminal part 150 may be primarily constructed of terminals having elastic characteristics. That is, as illustrated in FIG. 5, when the injection-molding is completed, the terminal parts 130 and 150 are attached to the molded frame 210 (see the solid-line features), but when the terminal parts 130 and 150 are separated from the molded frame 210 by an additional method (see the dotted-line features), the terminal parts 130 and 150 have elastic force therein.

The internal terminal part 130 and the external terminal part 150 may include components for securing additional elastic force. That is, external force is applied to bend the internal and external terminal parts 130 and 150 in order to apply elasticity to the internal and external terminal parts 130 and 150 after the molded frame 210 is injection-molded. In this case, a reinforcing part (not illustrated), such as a reinforcing member formed by pressing from one surface of the radiator 100 to the other surface of the radiator 100, is formed on a boundary of the internal and external connection parts 120 and 140 and the internal and external terminal parts 130 and 150 to provide additional elastic force of the internal and external terminal parts 130 and 150.

Further, the reinforcing part may further strengthen the boundary of the internal and external connection parts 120 and 140 and the internal and external terminal parts 130 and 150 and prevent the internal and external terminal parts 130 and 150 from being damaged by external shock.

The reinforcing part may be a reinforcing bead protruding from the boundary of the internal and external connection parts 120 and 140 and the internal and external terminal parts 130 and 150, respectively, or the boundary of the internal and external connection parts 120 and 140 and the internal and external terminal parts 130 and 150, respectively, may be rounded to become an elastic body.

However, the reinforcing part (not illustrated) is not limited to the aforementioned reinforcing bead or the rounded boundary, and may be modified to allow elastic force of the internal and external terminal parts 130 and 150 to be provided and prevent the internal and external terminal parts 130 and 150 from being damaged due to the force of external shocks being transferred thereto.

Figure 4:
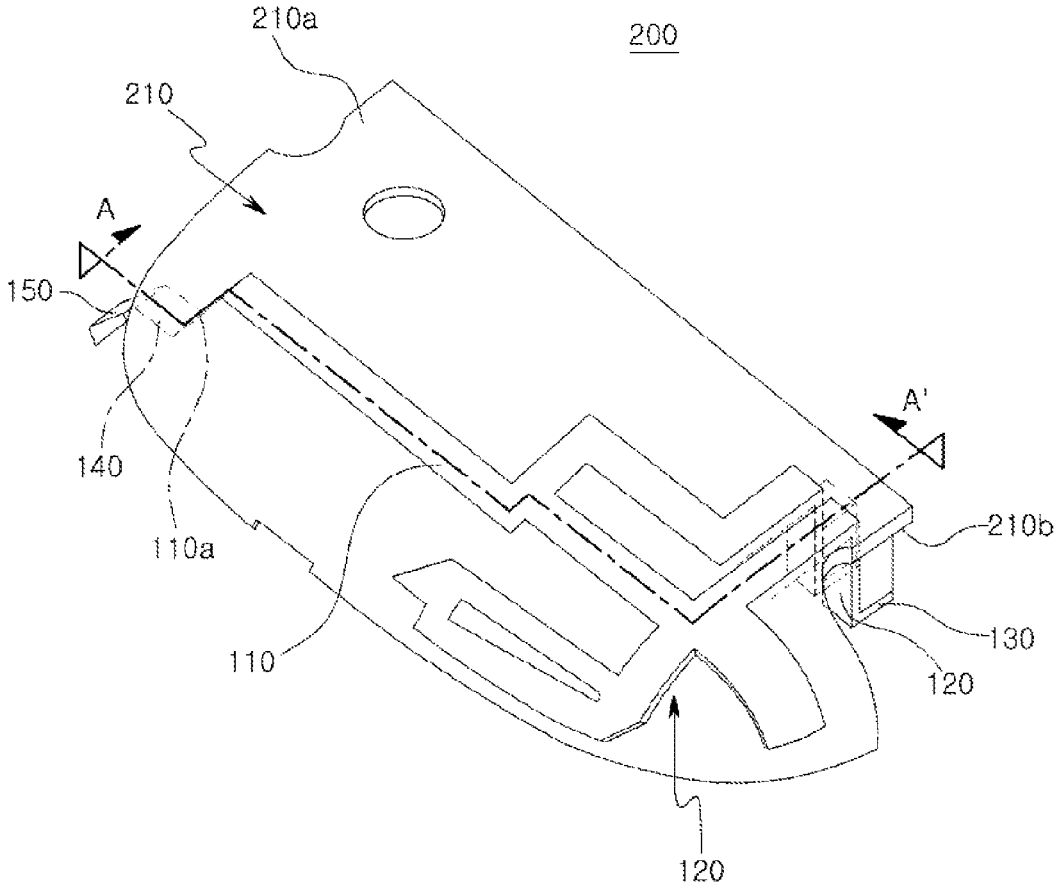
FIG. 4 is a schematic perspective view illustrating an example of the radiator frame.

FIG. 4 is a schematic perspective view illustrating the radiator frame 200 according to an example embodiment, and FIG. 5 is a schematic cross-sectional view taken along line A-A' of FIG. 4. Since the configuration of the radiator 100 has already been described in detail, the configuration of the radiator 100 will be omitted in the following description with respect to FIGS. 4 and 5.

Referring to FIGS. 4 and 5, the molded frame 210 may be manufactured by injection-molding the molded frame 210 around the radiator 100. The internal and external terminal parts 130 and 150 may be provided such that they have elasticity. That is, when the injection-molding of the molded frame 210 is completed to embed the radiator 100 therein, the internal and external terminal parts 130 and 150 may be rotated and bent to be spaced apart from each other in the molded frame 210. Since the radiator 100 is formed as an elastic body by the rotating and bending, the internal and external terminal parts 130 and 150 may have elasticity. Since a structure for reinforcing elastic force has been described above in detail, the structure will not be described.

The molded frame 210 may be an injection structure and the antenna pattern part 110 and the external terminal part 150 may be formed on the second surface 210*a* of the molded frame 210 and the internal terminal part 130 may be formed on the first surface 210*b* of the molded frame 210 opposing the second surface 210*a*.

FIGS. 6 through 9 are cross-sectional views illustrating an example of a manner in which the radiator may be connected to a metal component (an additional/auxiliary radiator) provided on the exterior of the case 410 and 520 (FIGS. 1 and 2).

Figure 6:
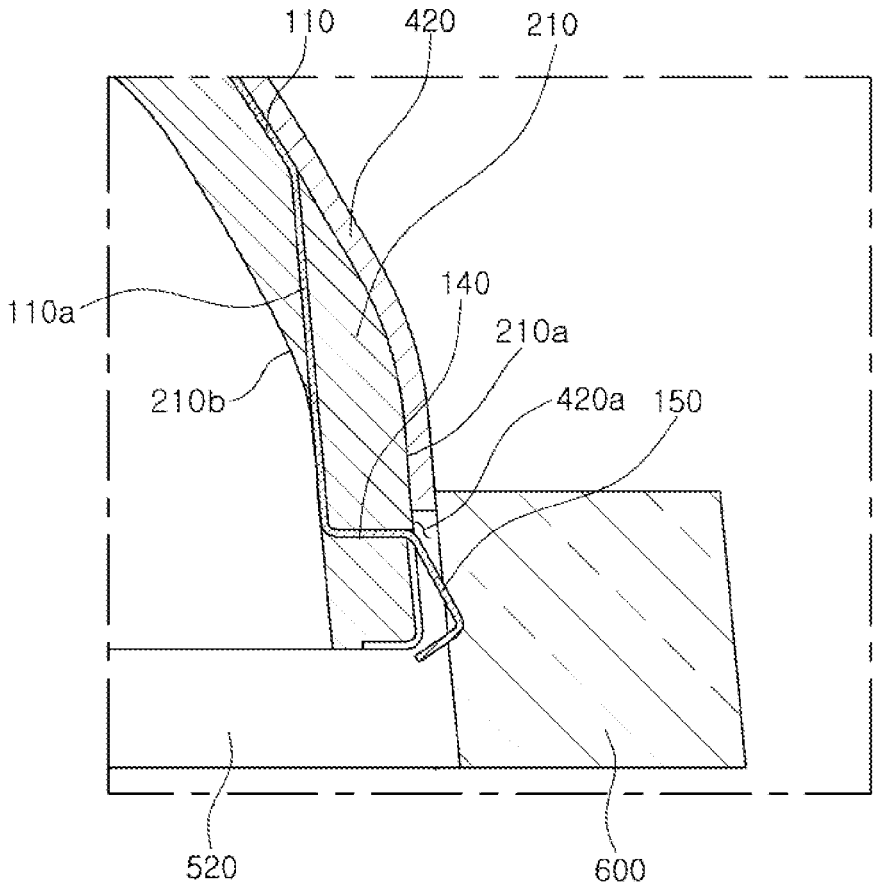
FIGS. 6 and 7 are cross-sectional views illustrating an example of a manner in which the radiator is connected to a metal component (an additional/auxiliary radiator) provided on the exterior of an electronic device case.

Referring to FIG. 6, the metal frame 600 is provided on the outer edge of the terminal 400 and the metal frame 600 is connected to the antenna pattern part 110 to additionally serve as an antenna radiator, thereby improving the performance of the antenna.

That is, the metal frame 600 covers exterior portions of the case 410 and 520, and the metal frame 600 is connected to the external terminal part 150 which is connected to the antenna pattern part 110 and configured to have an elastic force. The battery cover 420 may be provided to cover a battery mounting part and the radiator frame 200.

Figure 7:
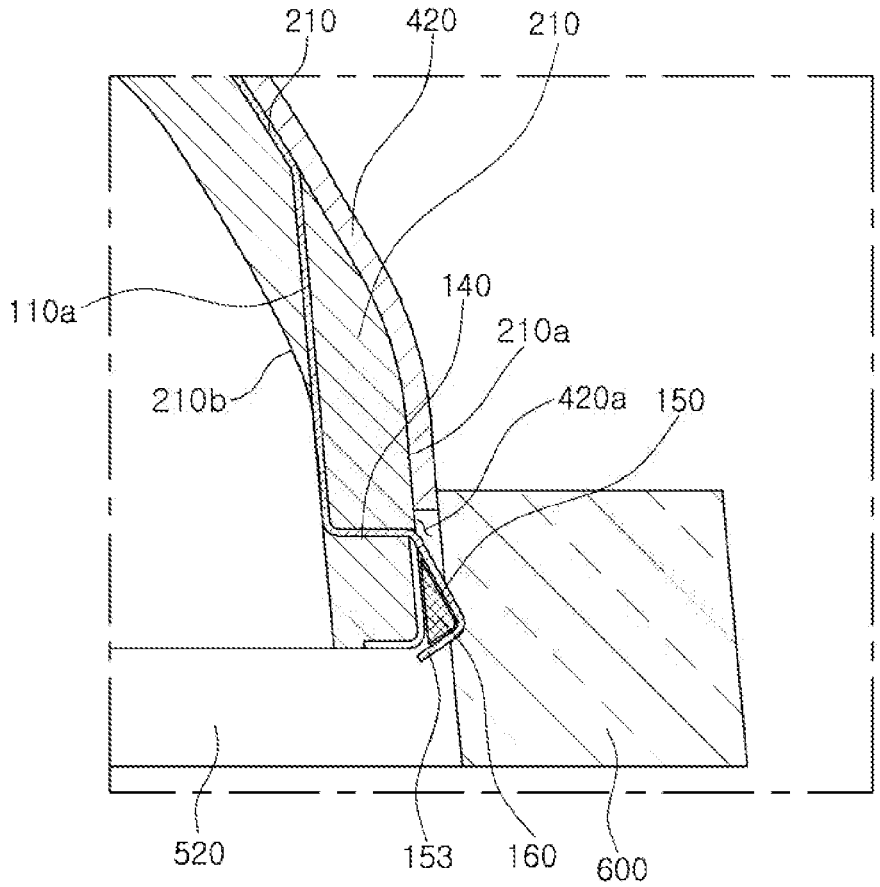

Referring to FIG. 7, an elastic member 160 may be inserted between the external terminal part 150 and the second surface 210*a* of the molded frame 210 to apply an additional elastic force to coupling of the external terminal part 150 and the metal frame 600.

Figure 8:
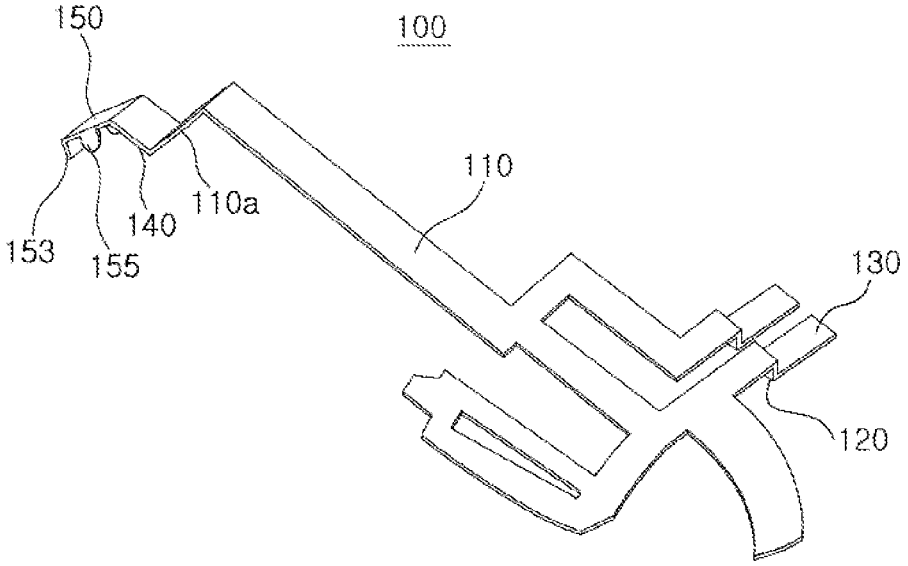
FIG. 8 is a schematic perspective view illustrating an example of a radiator according to another embodiment.
Figure 9:
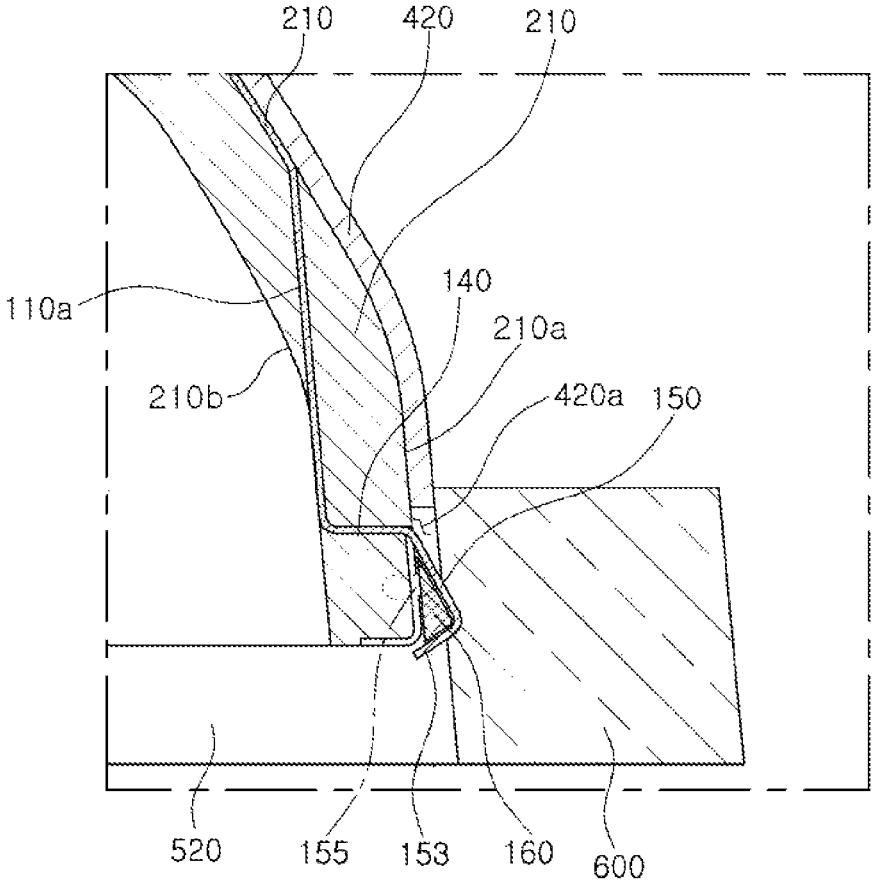
FIG. 9 is a cross-sectional view illustrating an example of a manner in which, when the radiator illustrated in FIG. 8 is used, the metal component provided on the exterior of the electronic device case and the radiator are connected.

In addition, referring to FIGS. 8 and 9, the external terminal part 150 includes a longitudinal confinement part 153 and a width-direction confinement part 155 configured to prevent the elastic member 160 from being separated from the external terminal part 150 in the longitudinal direction or the width direction.

Figure 10:
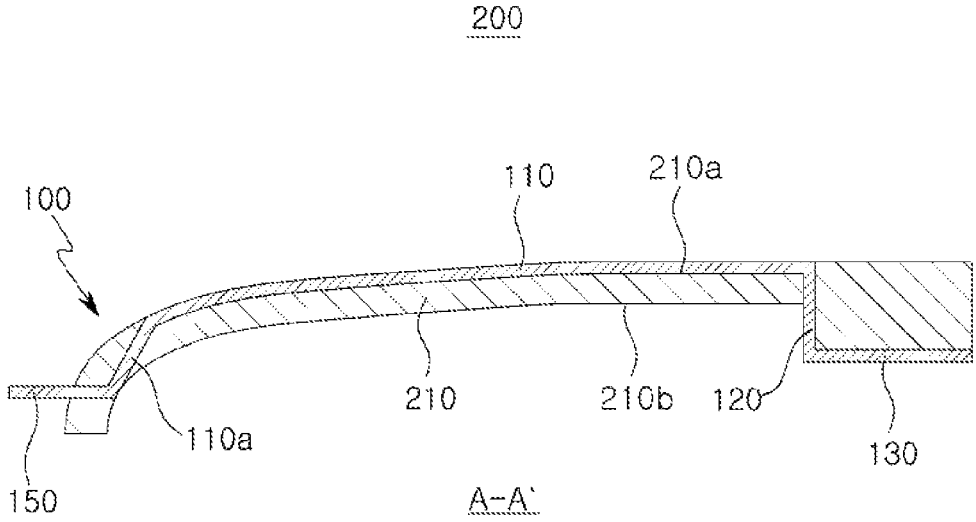
FIG. 10 is a cross-sectional view illustrating an example of a manner in which a radiator is molded within a radiator frame according to another embodiment.
Figure 11:
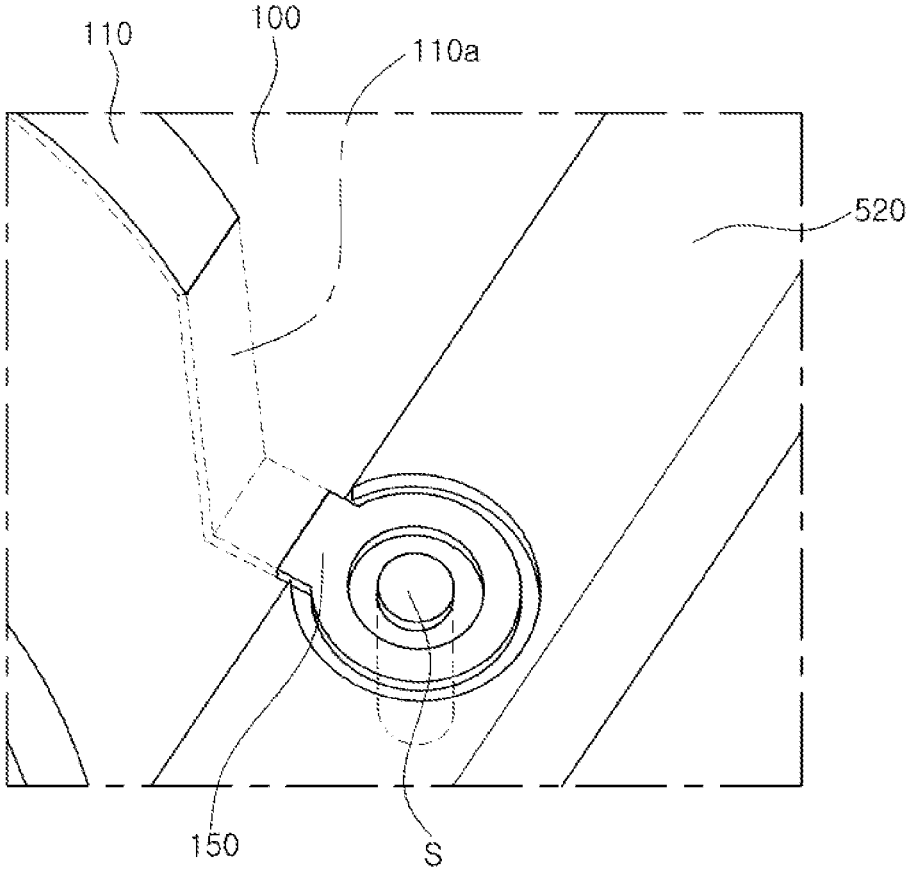
FIG. 11 is a reference diagram illustrating an example of a manner in which the radiator of FIG. 10 is fixed to a main case.

FIG. 10 is a cross-sectional view illustrating an example of a manner in which the radiator 100 may be molded within the radiator frame 200, and FIG. 11 is a reference diagram illustrating an example of a manner in which the radiator 100 may be fixed to the main case portion 520.

Referring to FIGS. 10 and 11, the metal frame 600 may be provided on the exterior of the terminal 400, and the metal frame 600 is connected to the antenna pattern part 110 to additionally function as an antenna radiator, thereby improving the performance of the antenna.

That is, as previously discussed, the metal frame 600 may be connected to the external terminal part 150 which is connected to the antenna pattern part 110. Herein, the external terminal part 150 is coupled to the main case portion 520 by a screw S, or the like, and the external terminal part 150 may be connected to the metal frame 600 by adding other connection means, or connected directly to the metal frame 600.

As previously described, the radiator frame 200 may be formed by injection-molding the molded frame 210 such that the radiator 100 including the internal and external terminal parts 130 and 150 is embedded in the molded frame 210. The radiator frame 200 may be formed through a single stage injection-molding operation, or the radiator frame 200 may be formed by a dual stage injection-molding operation including embedding one surface of the radiator 100 in a molded part in a primary stage and then forming the radiator frame 200 in a secondary stage by molding the molded frame 210 so that the antenna pattern part 110 other than the internal and external terminal parts 130 and 150 in the radiator 100 is embedded in the molded frame 210. In an example embodiment, the case 410 and 520 may be formed in the secondary stage.

As set forth above, according to example embodiments disclosed herein, the metal component (e.g., metal frame 600) provided on the edge of the case of the electronic device is used as an additional antenna to improve performance of an antenna.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A radiator frame comprising:

a main radiator including an antenna pattern part configured to transmit or receive a signal, an internal terminal part on one end of the antenna pattern part and configured to contact and thereby electrically connect the antenna pattern part to a signal circuit carried by a substrate, and an external terminal part on another end of the antenna pattern part and configured to contact and thereby electrically connect to an auxiliary radiator to improve radiation performance of the antenna pattern part; and a molded frame around the main radiator, the molded frame configured to expose the internal terminal part at a first surface of the molded frame, and configured to expose the external terminal part at a second surface of the molded frame, wherein the internal terminal part, the antenna pattern part and the external terminal part are formed integrally as one piece, the antenna pattern part is exposed at the second surface of the molded frame, and the antenna pattern part includes a support part that is connected to the external terminal part and embedded in the molded frame.

2. The radiator frame of claim 1, wherein the main radiator includes an external connection part that is bent on the antenna pattern part and connects the antenna pattern part to the external terminal part.

3. The radiator frame of claim 1, wherein a portion of the support part connected to the external connection part is exposed to the first surface of the molded frame.

4. The radiator frame of claim 1, wherein the support part is bent on the other end of the antenna pattern part to be embedded in the first surface of the molded frame.

5. The radiator frame of claim 1, wherein the external terminal part is spaced apart from the second surface of the molded frame and has elastic characteristics.

6. The radiator frame of claim 5, wherein an elastic member is disposed between the molded frame and the external terminal part.

7. The radiator frame of claim 1, wherein the external terminal part is bent to be spaced apart from the second surface of the molded frame after injection-molding the molded frame around the main radiator.

8. An electronic device comprising:

a case;

a radiator frame mounted in the case, the radiator frame including:

a radiator including an antenna pattern part configured to transmit or receive a signal, an internal terminal part on one end of the antenna pattern part, and an external terminal part on another end of the antenna pattern part, and a molded frame around the radiator, the molded frame configured to expose the internal terminal part at a first surface of the molded frame and to expose the external terminal part at a second surface of the molded frame;

a substrate having a signal circuit in contact with and thereby electrically connected to the internal terminal part and configured to receive the signal from the radiator or transmit the signal to the radiator; and a metal frame on the case contacting and thereby electrically connected to the external terminal part, wherein the internal terminal part, the antenna pattern part and the external terminal part are formed integrally as one piece, the antenna pattern part is exposed at the second surface of the molded frame, and the antenna pattern part includes a support part that is connected to the external terminal part and embedded in the molded frame.

9. The electronic device of claim 8, wherein the metal frame has a ring shape.

10. The electronic device of claim 8, wherein the external terminal part elastically contacts the metal frame.

11. The electronic device of claim 8, wherein the internal terminal part elastically contacts the signal circuit.

12. The radiator frame of claim 1, wherein the internal terminal part has elastic characteristics.

13. The radiator frame of claim 1, wherein the external terminal part has elastic characteristics.

* * * * *